US007832847B2

(12) United States Patent
Adachi et al.

(10) Patent No.: US 7,832,847 B2
(45) Date of Patent: Nov. 16, 2010

(54) DROPLET DISCHARGING APPARATUS AND METHOD OF MANUFACTURING THE DROPLET DISCHARGING APPARATUS

(75) Inventors: Yoshinori Adachi, Higashiosaka (JP); Kenji Koizumi, Higashiosaka (JP); Akiko Kusumoto, Kawachinagano (JP)

(73) Assignee: Cluster Technology Co., Ltd., Osaka (JP)

( * ) Notice: Subject to any disclaimer, the term of this patent is extended or adjusted under 35 U.S.C. 154(b) by 100 days.

(21) Appl. No.: 12/311,302

(22) PCT Filed: Oct. 26, 2006

(86) PCT No.: PCT/JP2006/321393

§ 371 (c)(1),
(2), (4) Date: Mar. 25, 2009

(87) PCT Pub. No.: WO2008/050431

PCT Pub. Date: May 2, 2008

(65) Prior Publication Data

US 2009/0309934 A1 Dec. 17, 2009

(51) Int. Cl.
*B41J 2/045* (2006.01)

(52) U.S. Cl. ..... 347/70

(58) Field of Classification Search ..... 347/70, 347/68, 69, 71, 72; 400/124.14, 124.16; 310/311, 324, 327

See application file for complete search history.

(56) References Cited

U.S. PATENT DOCUMENTS 4,459,601 A 7/1984 Howkins
7,033,002 B2 * 4/2006 Tanaka ..... 347/70
2005/0104941 A1 * 5/2005 Tanaka ..... 347/70
2005/0195248 A1 * 9/2005 Nagashima ..... 347/68
2006/0066689 A1 * 3/2006 Hori ..... 347/68

FOREIGN PATENT DOCUMENTS

JP 57-188372 11/1982
JP 10-278267 A1 10/1998
JP 2001-10042 A1 1/2001
JP 2003-165214 A1 6/2003
JP 2004-116327 A1 4/2004

* cited by examiner

*Primary Examiner*—K. Feggins
(74) *Attorney, Agent, or Firm*—Muirhead and Saturnelli, LLC

(57) ABSTRACT

A droplet discharging apparatus has a pressure chamber communicating with a nozzle, a vibration film forming a part of the pressure chamber, a piezoelectric element for vibrating the vibration film, a projection joined to the piezoelectric element and transmitting vibration of the piezoelectric element to the vibration film, and a flow path communicating with the pressure chamber. The apparatus has first and second members, with the vibration film, the projection, a groove, and a supply hole communicating with the groove being provided at the first member. The nozzle and the pressure chamber are formed in the second member. The first member and the second member are bonded together to form the flow path in the groove and also the pressure chamber in the recess. The groove and the recess partially overlap to form the flow path and the pressure chamber. A method is disclosed for manufacturing the droplet discharging apparatus.

7 Claims, 10 Drawing Sheets

DROPLET DISCHARGING APPARATUS AND METHOD OF MANUFACTURING THE DROPLET DISCHARGING APPARATUS

DROPLET DISCHARGING APPARATUS AND METHOD OF MANUFACTURING THE DROPLET DISCHARGING APPARATUS

FIELD OF THE INVENTION

This application relates to a droplet discharging apparatus and a method of manufacturing the droplet discharging apparatus. More particularly, this application relates to a droplet discharging apparatus which has a pressure chamber communicated with a nozzle, a diaphragm which is a member of the pressure chamber, a piezoelectric device for driving the diaphragm, a projection provided on the diaphragm to stay in direct contact with the piezoelectric device for transmitting the oscillating action of the piezoelectric device to the diaphragm, and a flow passage communicated with the pressure chamber, in which droplets of a liquid are discharged from its nozzle, and to a method of manufacturing the droplet discharging apparatus.

BACKGROUND OF THE INVENTION

A molded structure for use in such a conventional droplet discharging apparatus is known as disclosed in Patent Citation 1.

Patent Citation 1: WO02/002697.

As depicted in the citation, a nozzle chamber plate has a recess provided therein which acts as a group of separate ink chambers communicated with a nozzle, a group of separate. ink flow passages, and a common ink flow passage and bonded at the upper side with an oscillator plate. This type of structure is advantageous that the components about the nozzle are simplified. The two plates are bonded to each other by an adhesive or namely varnish as described in the citation. However, the bonding of the plates using such an adhesive. may flow into and block the flow passage.

It is assumed, as shown in FIG. 11A, that the nozzle chamber plate has a recess 42*x*' acting as a pressure chamber 42' equal to the separate ink chamber and a groove 35*x*' acting as a flow passage 35' of a square shape in the cross section. In the drawing, the recess and the groove in the nozzle chamber plate are expressed by the outlines. It is also noted that the nozzle chamber plate is joined by bonding to a diaphragm plate.

When the adhesive is applied to the upper side of the plate, it may stagnate in the upper corners CT due to its surface tension. When the two plate are joined to each other, the adhesive stagnating in the upper corners CT will run into the flow passage by contacting the other plate, thus choking the flow passage. The adhesive running into the flow passage may also stagnate in the lower corners CD, thus resulting possibly in the choking of the flow passage. In this case, as the lower corners CD are located close to the upper corners CT, their combination may encourage the choking of the flow passage and will hence decline the yield of the production.

For overcoming the choking of the flow passage at the corners with the adhesive, a modification may be made in which a tapered region 35*e*' is provided between the flow passage 35' and the pressure chamber 42', as shown in FIG. 11B. However, in the modification, the pressure developed in the pressure chamber 42' for delivering the liquid will be dispersed along the tapered region 35*e*', thus lowering the efficiency of dissipation of the pressure. It is also essential for maintaining the resistance to a flow in the flow passage to make another resistance to a flow in the tapered region 35', whereby the manufacturing process will be troublesome. Moreover, the tapered region 35*e*' may cause the construction about the pressure chamber 42' to be uneven in the rigidity.

Accordingly, it would be desirable to provide a droplet discharging apparatus which is simple in the structure, free from choking of the flow passage, and high in the manufacturing efficiency and a method of manufacturing the droplet discharging apparatus.

SUMMARY OF THE INVENTION

According to the system described herein, a droplet discharging apparatus has a pressure chamber communicated with a nozzle, a diaphragm which is a member of the pressure chamber, a piezoelectric device for driving the diaphragm, a projection provided on the diaphragm to stay in direct contact with the piezoelectric device for transmitting the oscillating action of the piezoelectric device to the diaphragm, and a flow passage communicated with the pressure chamber for discharging droplets of a liquid from the nozzle. Further, the droplet discharging apparatus is characterized by a first member and a second members, wherein the first member has a groove provided therein for incorporating the diaphragm, and the flow passage and a supply inlet provided therein for communicating with the groove, the second member has a recess provided therein for incorporating the pressure chamber, the first member and the second member being integrally fabricated respectively for being bonded together to have an overlap region between the groove and the recess which remain open to each other only toward the facing end in the proximity of the overlap region, so that the flow passage is formed in the groove and the pressure chamber is formed in the recess when the first member and the second member have been joined to each other with both the openings of the groove and the recess facing each other by an adhesive applied between the first member and the second member, thus allowing the flow passage and the pressure chamber to be communicated with each other by the overlap region of the groove and the recess.

As characterized, when the adhesive is applied for joining between an oscillator plate 30 acting as the first member and a nozzle plate 40 acting as the second member, it may stagnate on a pair of corners CS at the downstream end 35*a* of the flow passage 35 because the diaphragm 32 and the recess 35*x* are provided in the same oscillator plate 30, as shown in FIGS. 4 to 6. In the figures, the pair of corners CS are projected towards the space in the pressure chamber 42 and can thus prevent the stagnating adhesive from running into the flow passage when the two plates are joined. Also, the wall of the pressure chamber intersects linearly with the flow passage 35 at the cross corner CL. Because both the wall and the passage involve no corners, the adhesive even if running into will hardly stagnate at the cross corner CL. Meanwhile, in such an arrangement as shown in FIG. 9 where the downstream end 35*a* of the flow passage 35 is located at the outside of the pressure chamber 42', the adhesive running up to the pair of corners CS at the downstream end 35*a* will remain stagnated only at the end of the flow passage but hardly interrupt the succeeding flow passage. Accordingly, when the two plates 30, 40 are joined to each other with the groove, which acts as the flow passage, and the recess, which acts as the pressure chamber, placed one over the other to have an overlap region, the flow passage 35 can be prevented from being choked up with an excessive of the adhesive.

In the above described arrangement, the projection may be provided on the first member while the nozzle is provided in the second member. Also, the first member and the second member may be fabricated by a resin material.

Alternatively, the diaphragm may be arranged greater in the region covered with the projection than in the other remaining region when viewed from a direction which extends at a right angle to the diaphragm. This increases the area of the diaphragm which is situated beneath the projection and increased in the rigidity, hence allowing the diaphragm to oscillate throughout the area without being deflected and improve the efficiency of the pressing action in the pressure chamber.

Moreover, according further to the system described herein, a method is provided of manufacturing a droplet discharging apparatus which has a pressure chamber communicated with a nozzle, a diaphragm which is a member of the pressure chamber, a piezoelectric device for driving the diaphragm, a projection provided on the diaphragm to stay in direct contact with the piezoelectric device for transmitting the oscillating action of the piezoelectric device to the diaphragm, and a flow passage communicated with the pressure chamber for discharging droplets of a liquid from the nozzle. The method comprises the steps of: preparing a first member and a second members, the first member having a groove provided therein for incorporating the diaphragm and the flow passage and a supply inlet provided therein for communicating with the groove, the second member having a recess provided therein for incorporating the pressure chamber, the first member and the second member being integrally fabricated respectively for being bonded together to have an overlap region between the groove and the recess which remain open to each other only toward the facing end in the proximity of the overlap region; applying an adhesive between the first member and the second member; and bonding the first member and the second member to each other with both the openings of the groove and the recess facing each other thus to form the flow passage in the groove and the pressure chamber in the recess and simultaneously communicate between the flow passage and the pressure chamber by the overlap region of the groove and the recess.

The droplet discharging apparatus and the method of manufacturing the droplet discharging apparatus according to the system described herein are advantageous in that the flow passage can be avoided from being choked up with adhesive by the use of a simple structural arrangement while the manufacturing efficiency is improved. Also, the droplet discharging apparatus and the method of manufacturing the droplet discharging apparatus allow the pressure chamber to remain high in the rigidity and the efficiency of dissipation of the pressure but not needed to have a tapered wall provided at the inlet for the purpose of preventing the flow passage from being choked up with the adhesive.

Other objects, arrangements, and advantages of the present invention will be apparent from the following description of embodiments of the present invention.

DETAILED DESCRIPTION OF VARIOUS EMBODIMENTS

Figure 1:
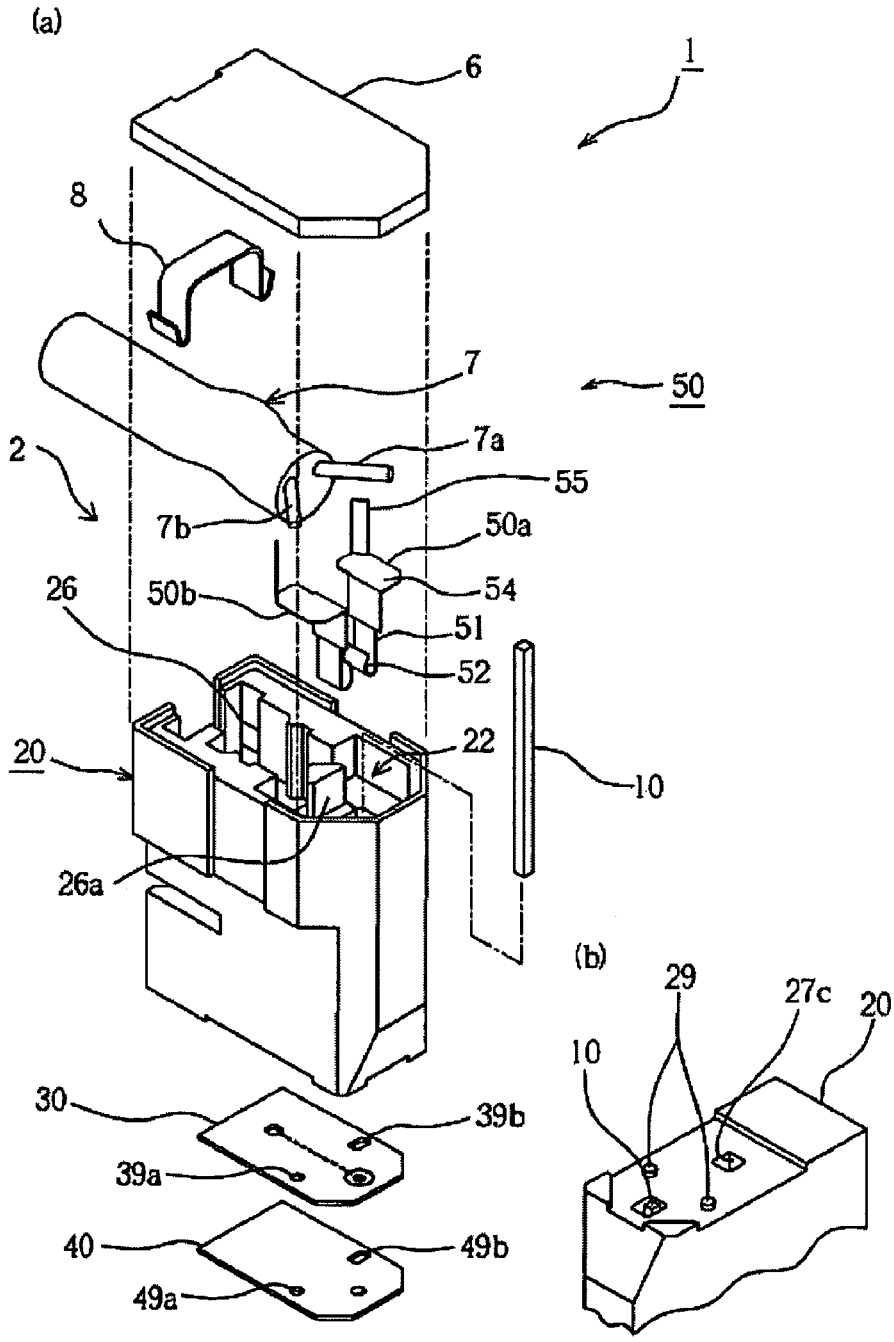
FIG. 1A is an exploded perspective view of a head and FIG. 1B is a perspective view of an arrangement in the proximity of a projection.

One embodiment of the present invention will be described referring to the relevant drawings. As shown in FIGS. 1 to 6, a droplet discharging apparatus 1 according to the present invention includes a head 2 for discharging from a nozzle 41 droplets of a liquid which has been supplied from a cartridge not shown. The head 2 comprises a piezoelectric device 10, an oscillator plate 30, a nozzle plate 40, contactors 50, an upper cover 6, and a cable 7 which all are fixedly mounted to a bracket 20. More specifically, the bracket 20, the oscillator plate 30, the nozzle plate 40, and the upper cover 6 are fabricated respectively by injection molding of resin materials. The components maybe fabricated using glass, metals, and other appropriate materials while the molding may be replaced with etching or electro-forming technique.

The bracket 20 has a groove 21 provided therethrough from the upper end to the lower end for guiding the piezoelectric device 10. The guiding groove 21 comprises from an upper open region 22 to the lower end, a mounting region 23, and a cavity region 24. Also, the bracket 20 has a second groove 25 provided in the proximity of the upper open region 22 and a third groove 26 provided in the upper side thereof to extend from the upper open region 22 to the back side of the bracket 20 where the cable 7 is fitted in. The bracket 20 furthermore has a communication inlet 27 provided in the back side thereof for communication with a cartridge. The bracket 20 has projections 29 provided on the lower side thereof and arranged to fit and engage with the oscillator plate 30 and the nozzle plate 40. A pressure chamber and a nozzle are provided in the lower front of the head 2 for being driven with the oscillator plate 30, the nozzle plate 40, and the piezoelectric device 10. The contactors 50 are fitted into the second groove 25 for electrically connecting between the piezoelectric device 10 and the cable 7.

Figure 2:
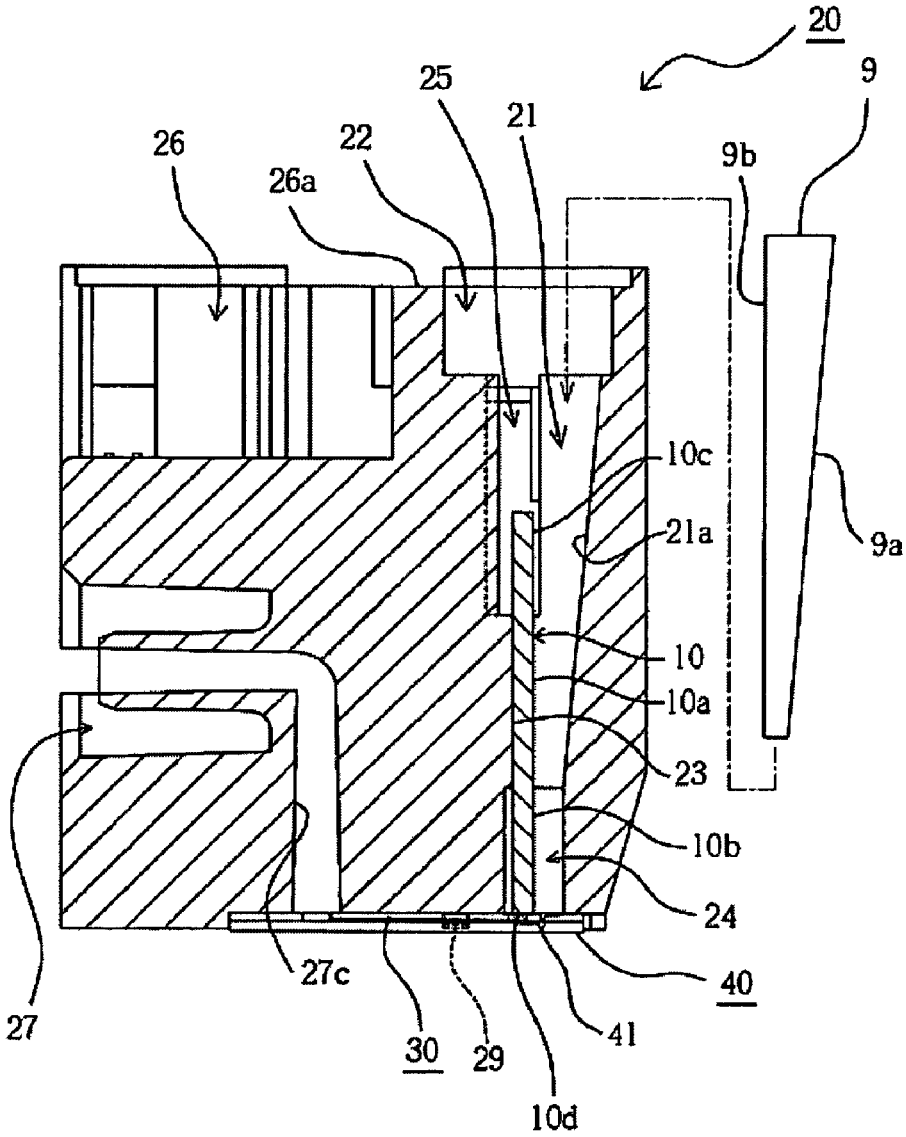
FIG. 2 is a longitudinally cross sectional view of the head.
Figure 3:
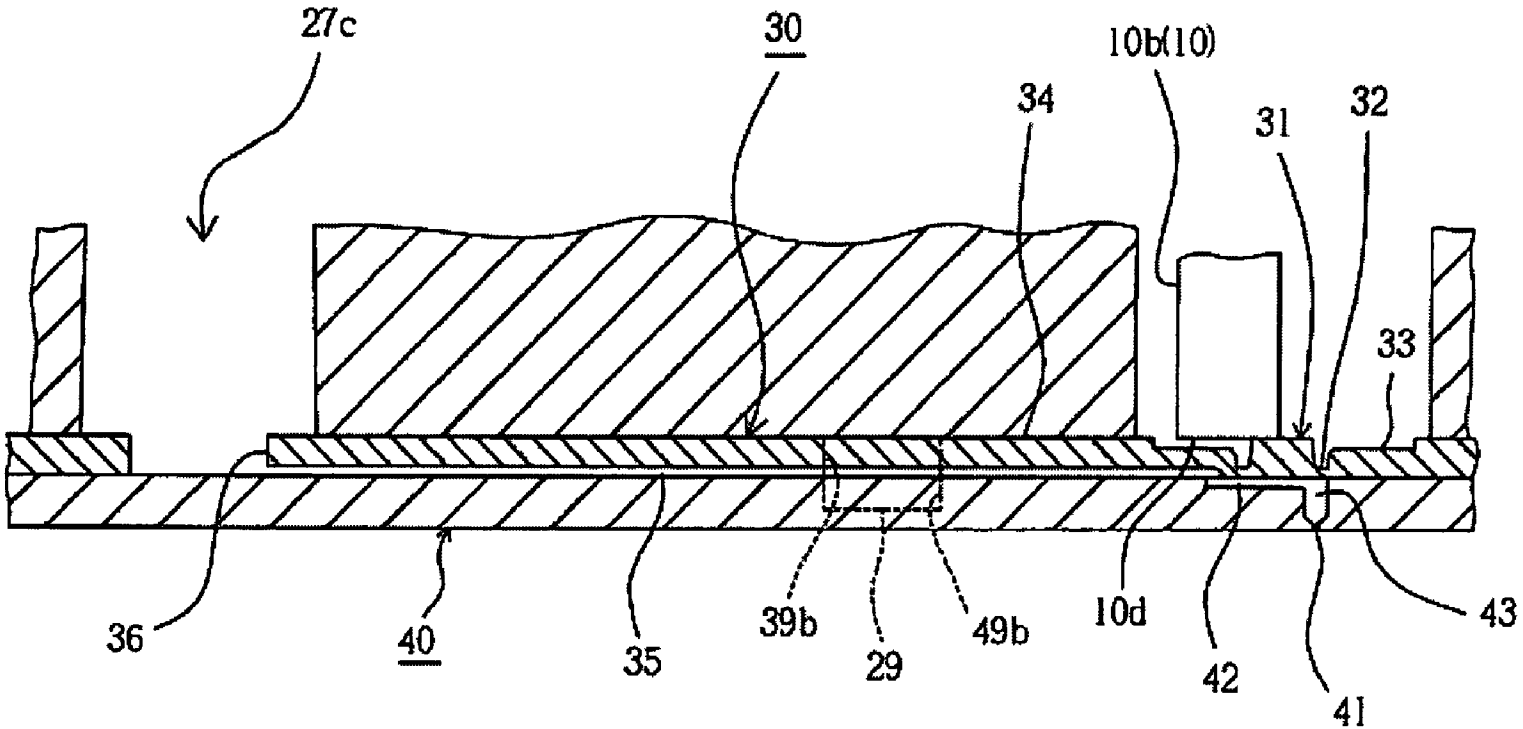
FIG. 3 is a lower longitudinally cross sectional view of the head.

The piezoelectric device 10 may be implemented by a PZT (lead zirconate titanate) material so that its activating portion 10*b* at the lower end can be expanded and contracted when being energized. As the piezoelectric device 10 is fixedly mounted at its center holding portion 10*a* to the bracket 20, its lower end 10*d* oscillates up and down for driving the diaphragm 32 through a projection 31 which will be explained later. A pair of external electrodes are provided on the upper connecting portion 10*c* of the piezoelectric device 10 for connection to bent portions 52 of the contactors 50 which extend from base portions 51. The piezoelectric device 10 is arranged of a square in the cross section and secured to the mounting region 23 with its distal end positioned in the cavity region 24 when having been inserted from the upper open region 22. More particularly, the piezoelectric device 10 is fixedly mounted by an adhesive to the mounting region 23 of the bracket 20. As shown in FIG. 2, the guiding groove 21 where the piezoelectric device 10 is installed extends from the upper end to the lower end of the bracket 20, thus allowing the projection 31 to be viewed from the upper opening region 22. The other side of the guiding groove 21 opposite to the piezoelectric device 10 mounted side has an inclined surface 21*a* which becomes closer to the piezoelectric device 10 from the upper open region 22 towards the lower end of the groove 21. The inclined surface 21*a* is configured to come into direct contact with the inclined surface 9*a* of a tooling 9 for ensuring the precise fitness between the piezoelectric device 10 and the mounting region 23 when the tooling 9 has been inserted.

The cable 7 with its leads 7*a*, 7*b* stripped at the distal end is fitted into the third groove 26 and securely held with the retainer 8. The leads 7*a*, 7*b* are separated to left and right by a partition 26*a* projected at the center in the upper open region 22 and connected to the first and second contactors 50*a*, 50*b* respectively by the connecting strips 55 folded down. Then, the upper cover 6 is mounted for protection at the upper end.

The oscillator plate 30 and the nozzle plate 40 are placed one over the other and bonded together before joined to the lower side of the bracket 20. The oscillator plate 30 has a round slot 39*a* and a long slot 39*b* provided therein through which a pair of projections 29 projected outwardly on the lower side of the bracket 20 extend respectively for determining the position. The nozzle plate 40 also has a round slot 49*a* and a long slot 49*b* provided therein at the locations corresponding to the round slot 39*a* and the long slot 39*b* respectively of the oscillator plate 30. The pair of projections 29 are fitted into the round slots 39*a*, 49*a* and the long slots 39*b*, 49*b* for accurately determining the position of the bracket 20, the oscillator plate 30 and the nozzle plate 40. In particular, the round slot 49*a* and the long slot 49*b* are provided not through but shut up at the bottom, hence allowing the projections 29 not to extend through the nozzle plate 40 and permitting the nozzle plate 40 to be easily cleaned down even if having been fouled with a leakage of the liquid while avoiding the mixture with unwanted types of liquid.

Figure 4:
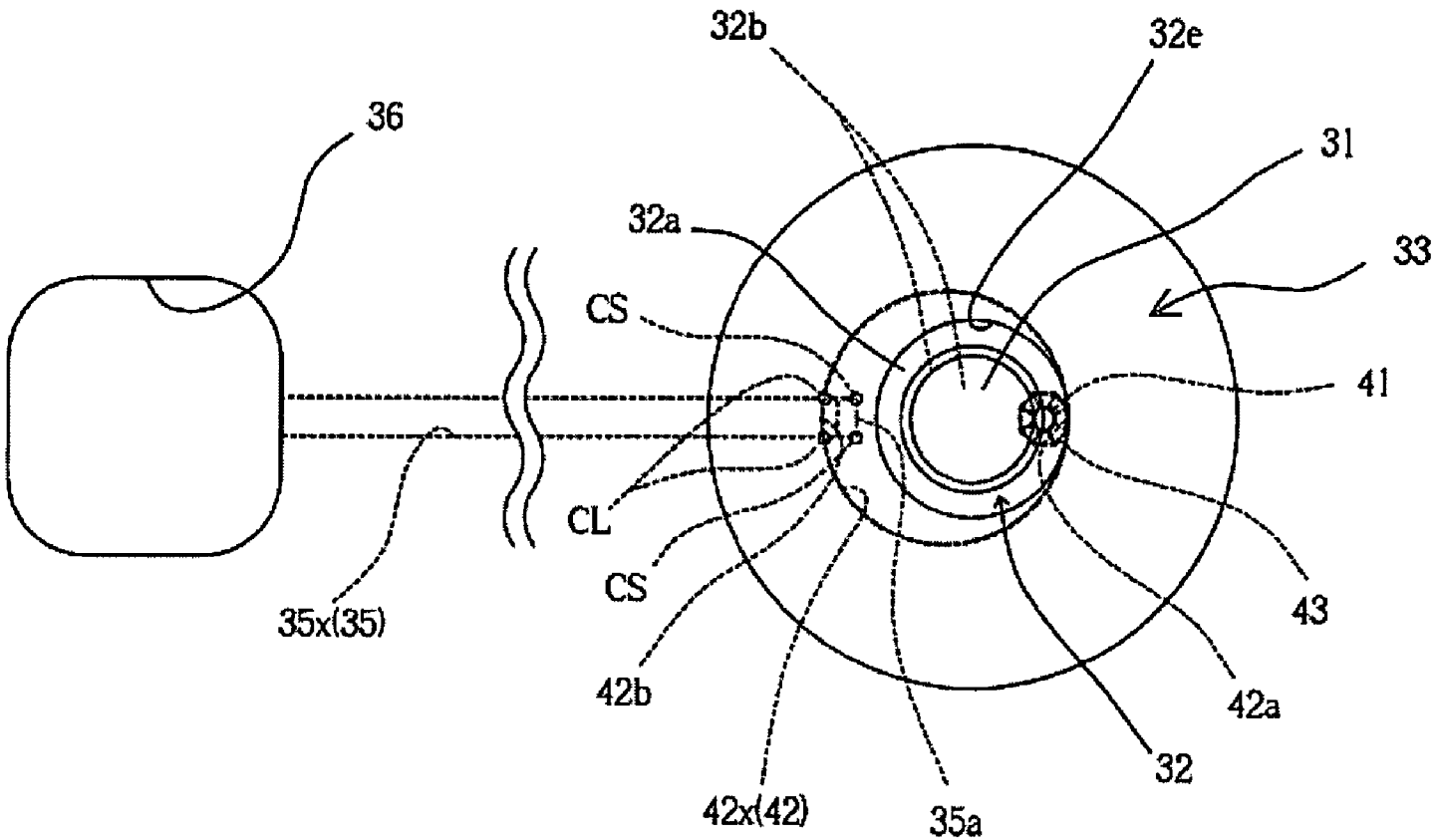
FIG. 4 is a plan view of an arrangement in the proximity of the projection and a communication aperture.
Figure 6:
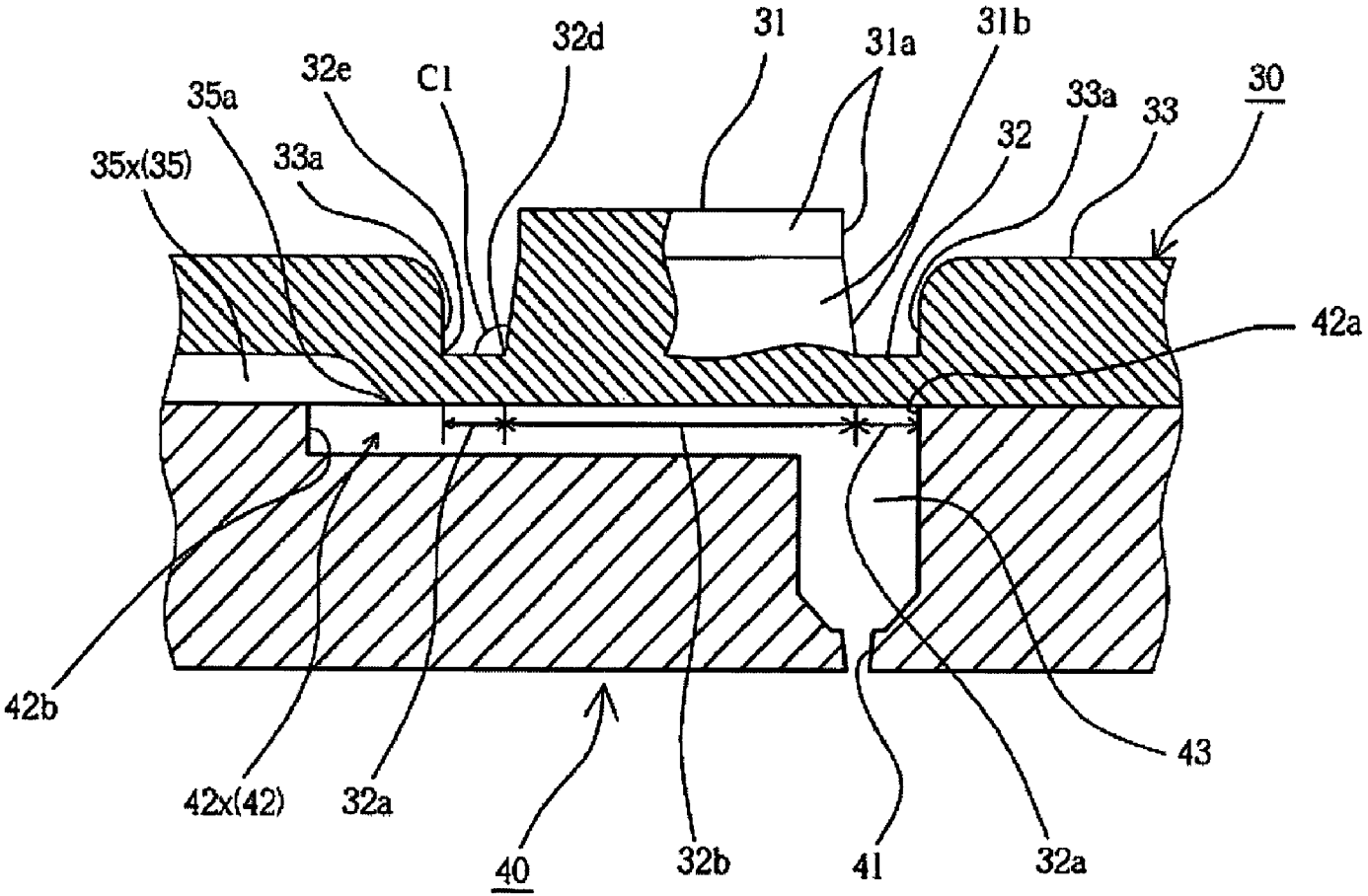
FIG. 6 is a longitudinally cross sectional view of an arrangement in the proximity of the projection.

The oscillator plate 30 includes the projection 31, the diaphragm 32, and a recessed portion 33 which are located beneath the lower end of the guiding groove 21 of the bracket 20. The nozzle plate 40 has a recess 42*x* provided in the upper side thereof for forming the pressure chamber 42 while the oscillator plate 30 has a groove 35*x* provided in the lower side thereof for forming the flow passage 35 which is communicated with the pressure chamber 42. When the two plates have been bonded to each other, the pressure chamber 42 and the flow passage 35 are produced. The flow passage 35 is further communicated across a communication aperture 36 to a flow passage 27*c* in the bracket 20. The projection 31, the diaphragm 32, and the recessed portion 33 are arranged concentrically at their boundaries and become greater in the diameter towards the outer edge, as shown in FIGS. 4 and 6. The pressure chamber 42 is communicated across a communication passage 43 to the nozzle 41. The piezoelectric device 10 remains at the lower end 10*d* partially in direct contact with the projection 31 as the piezoelectric device 10 and the projection 31 are securely joined by the adhesive to each other. The recessed portion 33 is greater in the outer edge than the lower end 10*d* of the piezoelectric device 10, whereby the lower end 10*d* can be avoided from coming into direct contact with the upper side 34 of the oscillator plate 30.

Figure 5:
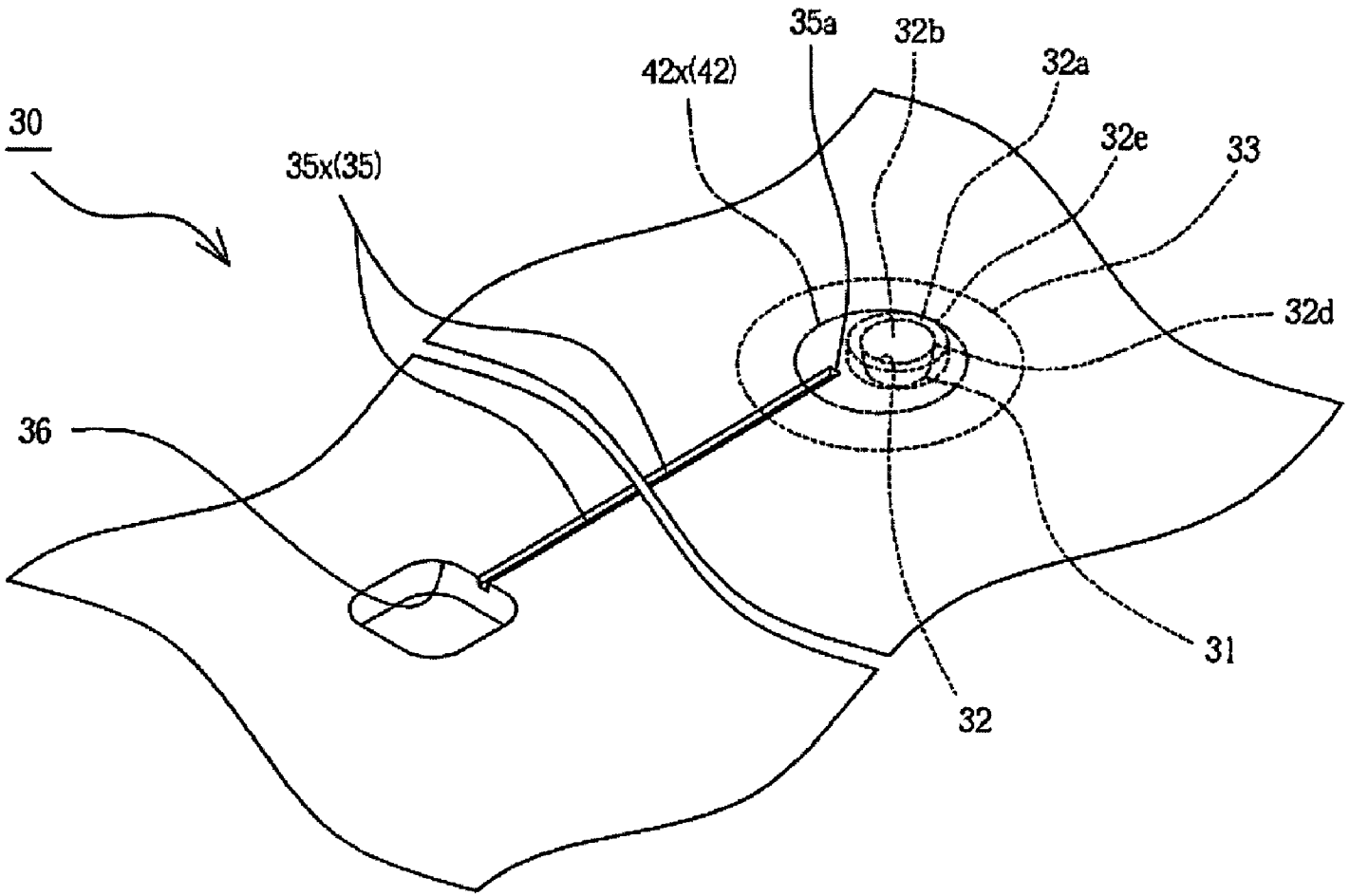
FIG. 5 is a perspective view seen from the bottom side of FIG. 4.

As shown in FIGS. 4 to 6, the base portion of the projection 31 close to the diaphragm 32 is enlarged in the cross section as coming close to the diaphragm 32. As the enlarged portion becomes greater in the diameter towards the diaphragm 32, its side wall at the enlarged portion is denoted by 31*b*. The joint angle C1 between the side wall 31*b* and the diaphragm 32 along the inner boundary 32*d* where the projection 31 meets the diaphragm 32 is set as an obtuse angle so that the inner boundary 32*d* with its neighbor area is increased in the rigidity while the removal from the molds after the molding process can easily be carried out. The inclined side wall 31*b* may be provided partially close to the inner boundary 32*d*.

Figure 8:
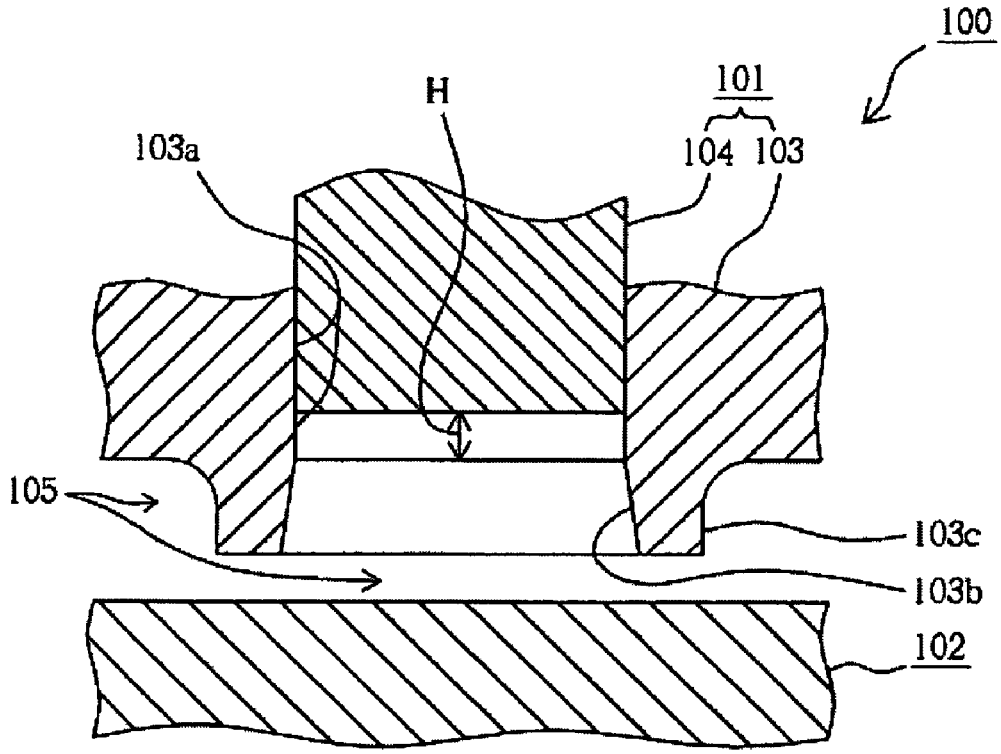
FIG. 8 is a longitudinally cross sectional view of molds for forming the projection and the diaphragm.

The side wall 31*b* of the projection 31 is arranged at its upper portion 31*a* to extend at a right angle to the diaphragm 32, whereby the overall form will be a circular cylinder in this embodiment. As the upper portion 31*a* of the projection 31 is arranged of a circular cylinder form, its rigidity can be maintained. This allows the molds for producing the form to be simply constructed with a combination of a cylindrical hole and a cylindrical pin. With the pin adjusted carefully in the elevation, the height of the upper portion 31*a* can be improved in the accuracy. In practice, the molds is constructed preferably as shown in FIG. 8. The molds 100 include an upper mold 101 and a lower mold 102. While the upper mold 101 has a pin 104 fitted into a cylindrical hole 103*a* provided in a base portion 103 thereof, the molding is carried out by filling a cavity 105 between the molds with a resin material. The insert position of the pin 104 in relation to the cylindrical hole 103*a* can easily be controlled so that the distance H between the lower end of the cylindrical hole 103*a* and the lower end of the pin 104 is equal to the height of the upper portion 31*a* of the projection 31. While its tapered surface 103*b* determines the shape of the side wall 31*b*, the upper mold 101 forms a part of the diaphragm 32 with its projected portion 103*c*.

The diaphragm 32 comprises a center portion 32*b* of a disk-like shape directly beneath the projection 31 and a circumferential portion 32*a* of an annular shape provided about the center portion 32*b*. In this embodiment, the center portion 32*b* is arranged greater in the area size than the circumferential portion 32*a*, as shown in the plan view of FIG. 4, whereby the oscillating movement of the piezoelectric device 10 can be transmitted uniformly to the projection 31 by the diaphragm 32.

Figure 7:
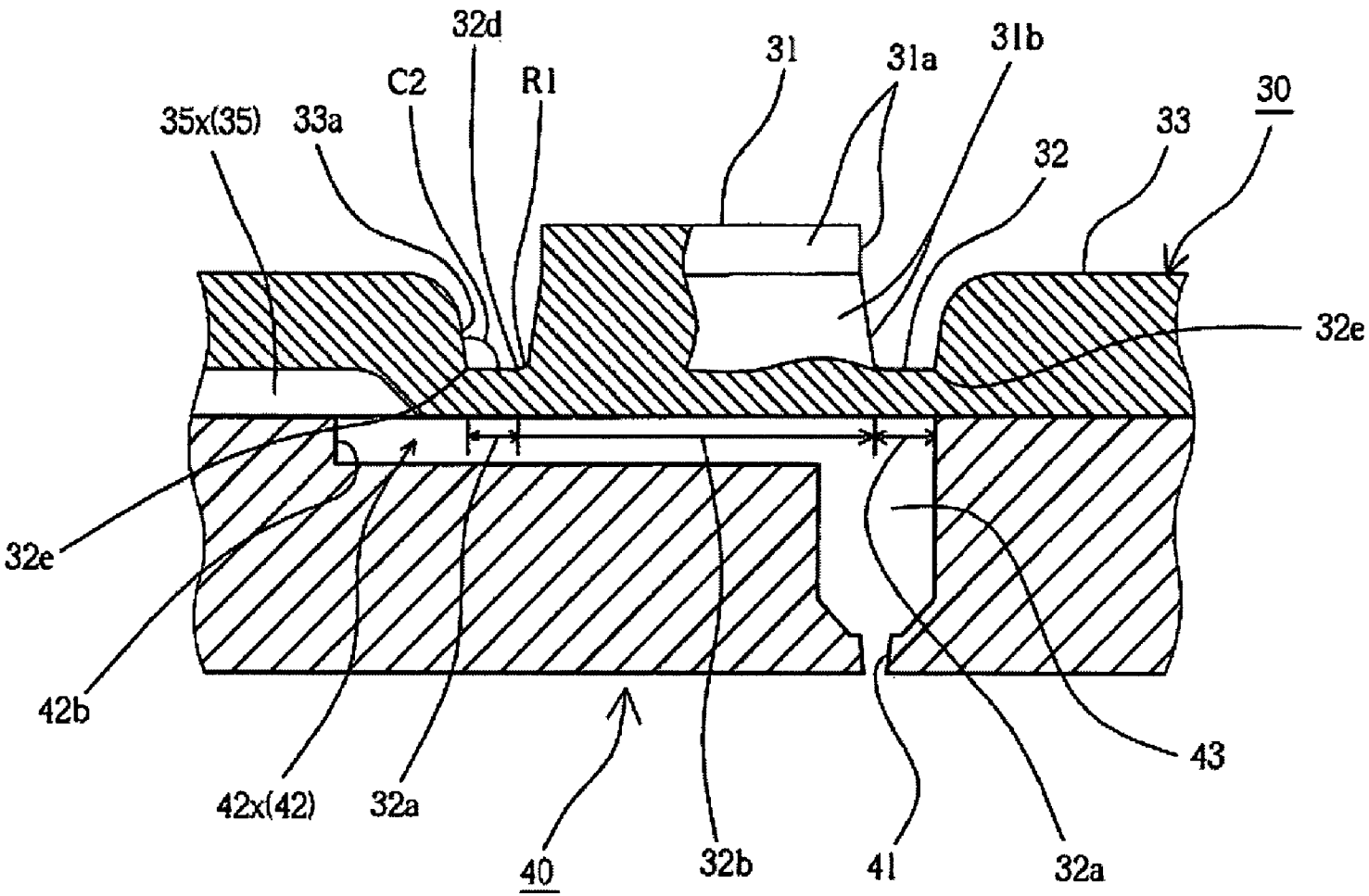
FIG. 7 illustrates another modification of the arrangement shown in FIG. 6.

Alternatively, instead of the joint angle C1 set as an obtuse angle, the lower end of the projection 31 along the inner boundary 32*d* may be formed to a rounded corner R1 as shown in FIG. 7. In this case, the projection 31 has a so-called beveled bottom along the inner boundary 32*d*. Meanwhile, an inner wall 33*a* of a cylindrical shape is provided between the recessed portion 33 and the diaphragm 32. The joint angle C2 between the inner wall 33*a* and the diaphragm 32 along the outer boundary 32*e* may be set as an obtuse angle so that the diaphragm 32 can be increased in the rigidity and improved in the removal from the molds. Similar to the inner boundary 32*d* and the side wall 31*b*, the outer boundary 32*e* may be modified with a rounded corner and the inner wall 33*a* may be inclined as becoming close to the projection 31 towards the diaphragm 32.

Since the pressure chamber 42 is greater in the outer diameter than the diaphragm 32, it is overlapped just beneath as eccentric with the diaphragm 32 so that its downstream side wall 42*a* of the pressure chamber 42 coincides substantially with the outer boundary 32*e* of the diaphragm 32 at the communication passage 43 side. This eccentricity allows a clearance to be developed between the upstream side wall 42*b* of the pressure chamber 42 and the outer boundary 32*e* of the diaphragm 32 at the flow passage 35 side. Accordingly, the clearance is thus communicated with the downstream end 35*a* of the flow passage 35.

Before the oscillator plate 30 and the nozzle plate 40 are bonded to each other, they are coated with an adhesive. The adhesive may be a liquid type thermo-set adhesive agent or. the like. Preferably, a type of varnish in which the same resin material as of the two plates 30, 40 is dispersed is used as the adhesive. For the application, some drops of the adhesive are spotted on the joining side of one of the two plates 30, 40 and spread uniformly by the spinning action of a spin coater. The other plate is then placed and bonded to the joining side of the adhesive coated plate. Then, the two joined plates 30, 40 are placed between dies, overlap with each other and, if the adhesive is of thermo-set type, heated in a furnace for curing the adhesive.

In this embodiment, the diaphragm 32 and the flow passage are provided in the same oscillator plate 30 as described above, so that the pair of corners CS at the downstream end 35*a* of the flow passage 35 where the adhesive tends to stagnate are gently projected towards the space in the pressure chamber 42 and thus avoid the flow passage 35 from being choked up.

The action of assembling the above-described head 2 starts with the piezoelectric device 10 being coated with an adhesive, inserted into the guiding groove 21 from its upper open region 22, and secured at the mounting region 23 in the groove 21. Then, the tooling 9 is inserted into the guiding groove 21 and its inclined side 9*a* and contact side 9*b* come into direct contact with the wall of the groove 21 and the piezoelectric device 10 respectively, whereby the piezoelectric device 10 can be secured at the mounting region 23. The adhesive is then cured.

At a separate step, the oscillator plate 30 and the nozzle plate 40 are bonded to each other. Then, their round slots 39*a*, 49*a* and the long slots 39*b*, 49*b* are engaged with the pair of projections 29 on the lower side of the bracket 20 and bonded together. Before the two plates 30, 40 are joined to the bracket 20, the lower end 10*d* of the piezoelectric device 10 is coated with an adhesive and bonded directly to the projection 31 of the oscillator plate 30.

Then, while the contactors 50 are inserted into the second grooves 25, the cable 7 is inserted into the third groove 26 and its leads 7*a*, 7*b* are secured with the connecting strips 55 being folded down, thus completing the electrical connection between the external electrodes 10*f*1, 10*f*2, the two, first and second, contactors 50*a*, 50*b*, and the leads 7*a*, 7*b* respectively. With the cable 7 being supplied with an actuating current, the projection 31 can be observed through the guiding groove 21. This allows the bonding state between the lower end 10*d* of the piezoelectric device 10 and the projection 31 to be examined from the oscillating movement of the projection 31.

Other embodiments of the present invention will then be described in the respect to provability. Like components are denoted by like numerals as those of the previous embodiment.

Figure 9:
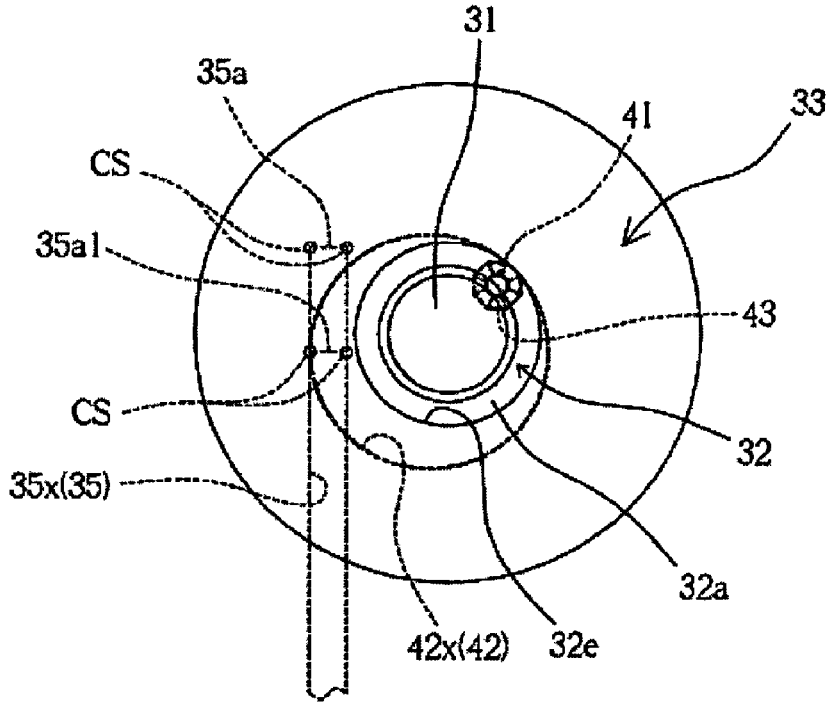
FIG. 9 is a plan view showing another modification of the arrangement in the proximity of the projection.
Figure 10:
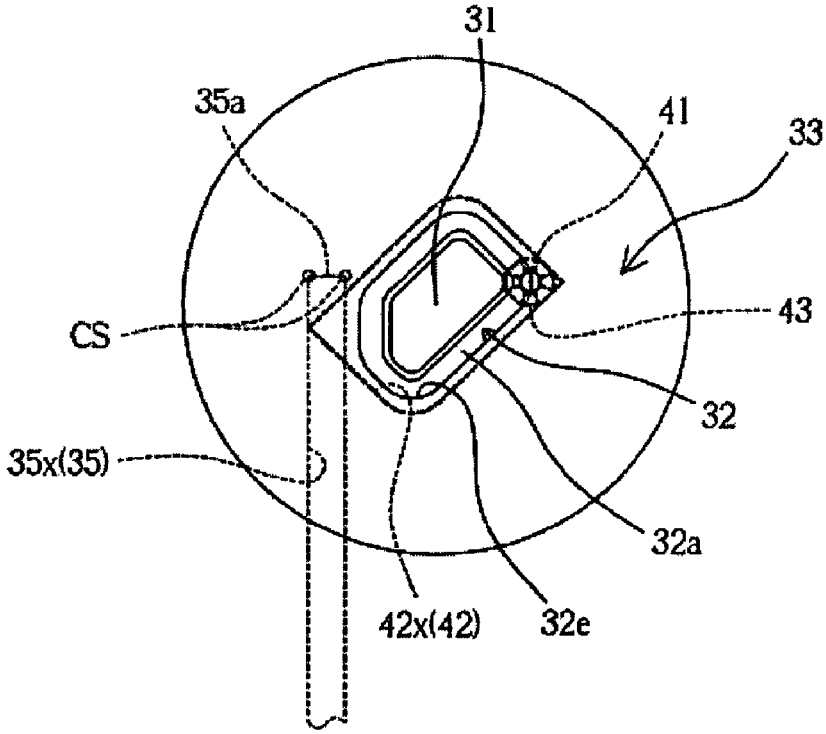
FIG. 10 is a plan view showing a further modification of the arrangement in the proximity of the projection.
Figure 11:
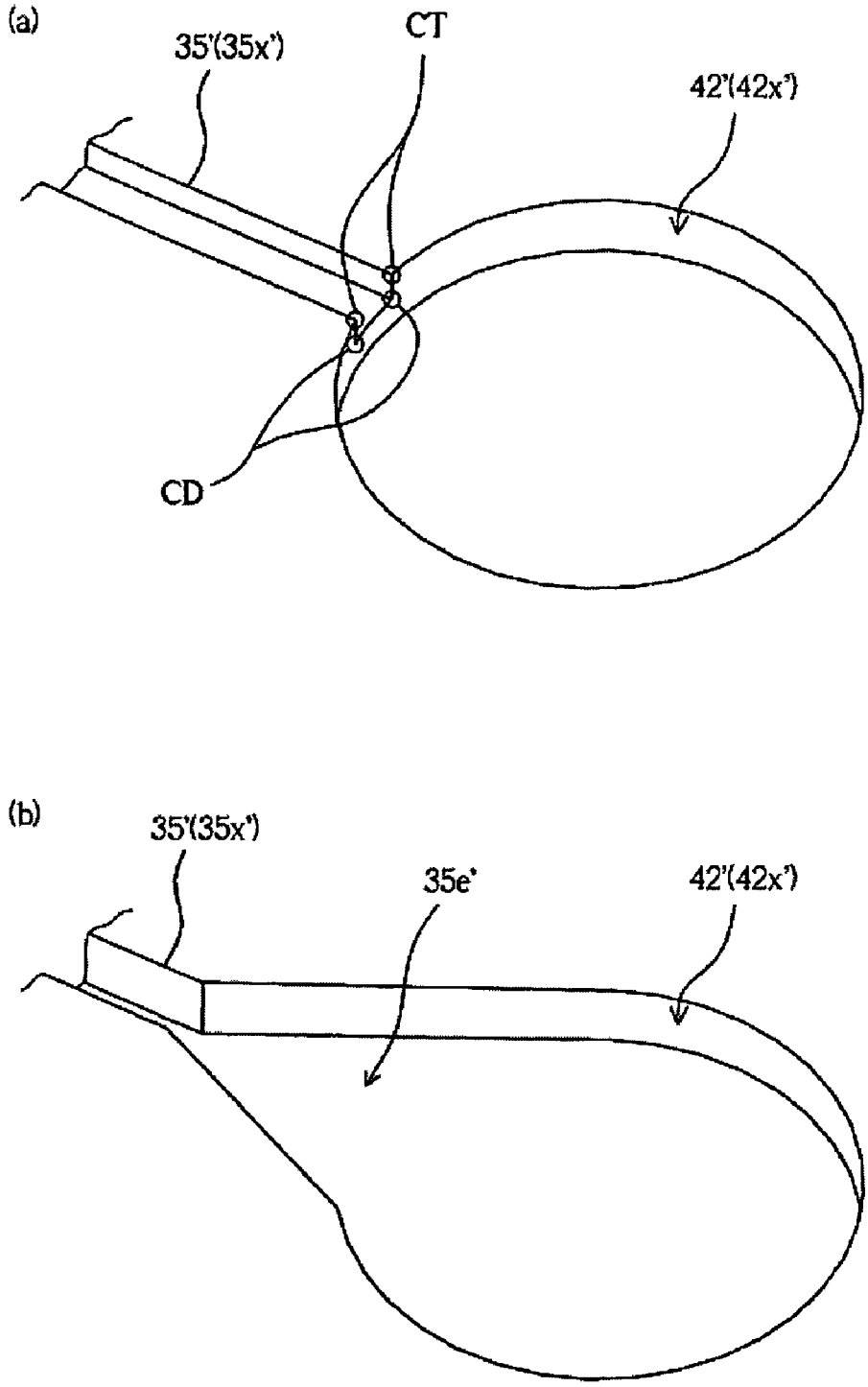
FIG. 11 is a perspective view showing the relationship between a pressure chamber and a communication passage in the prior art.

In the above described embodiment, the flow passage 35 is arranged to extend across the center of the pressure chamber 42. However, as shown in FIG. 9, the flow passage 35 may be biased to one side of the pressure chamber 42 so that it overlaps partially with the pressure chamber 42. While the downstream end 35*a* of the flow passage 35 is located just over the pressure chamber 42 as shown in the previous embodiment, it may be extended further to the outside of the pressure chamber 42. In any case, the flow passage can be avoided from being choked up with the adhesive even when the adhesive tends to stagnate on the pair of corners CS. Also, the projection 31 and the pressure chamber 42 are not limited to a circular shape but may be arranged of such a particular shape as shown in FIG. 10. The droplet discharging apparatus and the method of manufacturing the droplet discharging apparatus according to the system described herein may be modified in various forms without departing from the scope of the present invention.

INDUSTRIAL APPLICABILITY

The present invention is applicable to chemical experiments, biotechnology experiments, medical diagnosis, electronics production, and so on. The liquid may be selected from various types. For example, the liquid may contain biological materials such as DNA, protein, or fungus, fluorescent particles, electrically conductive particles, resin particles, ceramic particles, pigments, or dyes. It is suitable for discharging droplets of high surface-tension liquid such as distilled water or expensive liquid. It is also suitable for drawing lines through printing as well as fabricating electrodes and micro-lenses. Moreover, the present invention is favorable for applying an array of droplets at desired locations such as forming biological chips, producing flavors through dispensing or spraying, providing a mixture through controlling the amount to be discharged, or forming films.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. A droplet discharging apparatus, comprising:

a pressure chamber communicated with a nozzle;

a diaphragm which is a member of the pressure chamber;

a piezoelectric device for driving the diaphragm;

a projection provided on the diaphragm to stay in direct contact with the piezoelectric device for transmitting the oscillating action of the piezoelectric device to the diaphragm;

a flow passage communicated with the pressure chamber for discharging droplets of a liquid from the nozzle; and a first member and a second member, wherein the first member has a groove provided therein for incorporating the diaphragm, and the flow passage and a supply inlet provided therein for communicating with the groove, the second member has a recess provided therein for incorporating the pressure chamber, the first member and the second member being integrally fabricated respectively for being bonded together to have an overlap region between the groove and the recess which remain open to each other only toward the facing end in the proximity of the overlap region, so that the flow passage is formed in the groove and the pressure chamber is formed in the recess when the first member and the second member have been joined to each other with both the openings of the groove and the recess facing each other by an adhesive applied between the first member and the second member, thus allowing the flow passage and the pressure chamber to be communicated with each other by the overlap region of the groove and the recess.

2. The droplet discharging apparatus according to claim 1, wherein the first member and the second member are fabricated by a resin material.

3. The droplet discharging apparatus according to claim 1, wherein the diaphragm is arranged greater in the region covered with the projection than in the other remaining region when viewed from a direction which extends at a right angle to the diaphragm.

4. The droplet discharging apparatus according to claim 1, wherein the projection is provided on the first member while the nozzle is provided in the second member.

5. The droplet discharging apparatus according to claim 4, wherein the first member and the second member are fabricated by a resin material.

6. The droplet discharging apparatus according to claim 4, wherein the diaphragm is arranged greater in the region covered with the projection than in the other remaining region when viewed from a direction which extends at a right angle to the diaphragm.

7. A method of manufacturing a droplet discharging apparatus which has a pressure chamber communicated with a nozzle, a diaphragm which is a member of the pressure chamber, a piezoelectric device for driving the diaphragm, a projection provided on the diaphragm to stay in direct contact with the piezoelectric device for transmitting the oscillating action of the piezoelectric device to the diaphragm, and a flow passage communicated with the pressure chamber for discharging droplets of a liquid from the nozzle, the method comprising:

preparing a first member and a second members, the first member having a groove provided therein for incorporating the diaphragm and the flow passage and a supply inlet provided therein for communicating with the groove, the second member having a recess provided therein for incorporating the pressure chamber, the first member and the second member being integrally fabricated respectively for being bonded together to have an overlap region between the groove and the recess which remain open to each other only toward the facing end in the proximity of the overlap region;

applying an adhesive between the first member and the second member; and bonding the first member and the second member to each other with both the openings of the groove and the recess facing each other thus to form the flow passage in the groove and the pressure chamber in the recess and simultaneously communicate between the flow passage and the pressure chamber by the overlap region of the groove and the recess.

* * * * *